United States Patent [19]

Markunas et al.

[11] Patent Number: 5,036,267

[45] Date of Patent: Jul. 30, 1991

[54] AIRCRAFT TURBINE START FROM A LOW VOLTAGE BATTERY

[75] Inventors: Albert L. Markunas, Roscoe; Gregory I. Rozman, Rockford, both of Ill.

[73] Assignee: Sundstrand Corporation, Rockford, Ill.

[21] Appl. No.: 451,447

[22] Filed: Dec. 15, 1989

[51] Int. Cl.[5] ..... F02N 11/00

[52] U.S. Cl. ..... 322/10; 322/29; 363/96

[58] Field of Search ..... 322/10, 11, 14, 29; 290/31, 38 R, 46; 363/57, 58, 96

[56] References Cited

U.S. PATENT DOCUMENTS

| | | | |
|---|---|---|---|
| 3,820,006 | 6/1974 | Phillips | 363/96 |
| 3,908,130 | 9/1975 | Lafuse | 290/31 X |
| 3,939,392 | 2/1976 | Chalmers et al. | 363/96 |
| 4,330,743 | 5/1982 | Glennon | 322/29 X |
| 4,489,323 | 12/1984 | Glennon et al. | 322/29 |
| 4,775,924 | 10/1988 | Sweezy | 363/58 X |
| 4,786,852 | 11/1988 | Cook | 322/10 |
| 4,841,216 | 6/1989 | Okada et al. | 322/10 |

*Primary Examiner*—Steven L. Stephan
*Assistant Examiner*—Kristine Peckman
*Attorney, Agent, or Firm*—Whitham & Marhoefer

[57] ABSTRACT

A low voltage battery provides the power source for energizing an aircraft generator to operate it as a motor during a starting operation. The battery is coupled to an input to an inverter whose a.c. output is controlled by a pulse width modulator. By controlling the switching points of the output, the generator is so energized that it operates as a brushless d.c. motor. At a point where the available voltage to the generator is insufficient to further accelerate the turbine, even with field weakening and an increased commutation angle, an autotransformer is switched into the system to step up the output voltage from the invertor. Throughout the starting operation the commutation angle is controlled so that current drain on battery is such that the battery terminal voltage at one half its no load terminal voltage, thus providing maximum power transfer from the battery.

7 Claims, 4 Drawing Sheets

TO INVERTER
36
MAIN INVERTER PWM
38
104
LIMIT FUNCTION
136
87
TO SWITCH
48
VB
89
134
CA
130
COMPENSATION UNIT
110
Vo
111
85
1/2Hz
83
MULTIPLIER
106
SPEED COMPARATOR
732
30
EXCITATION INVERTER PWM
146
COMPENSATION UNIT
TRANSFORMER 60
V1/Hz
108
SPEED SIGNAL CONVERTER
68
105
122
142
140
BATTERY TERMINAL VOLTAGE
VOLTAGE REFERENCE
107
EXCITATION INVERTER CURRENT SCHEDULER
54
ROTOR POSITION
52

AIRCRAFT TURBINE START FROM A LOW VOLTAGE BATTERY

BACKGROUND OF THE INVENTION

1. Related Application

This application is related in subject matter to copending application Ser. No. 07/448,669, filed Dec. 12, 1989, by Gregory I. Rozman, for "Low Voltage Aircraft Engine Starting System." Application Ser. No. 07/448,669 is assigned to the assignee of this application and is incorporated herein by reference.

2. Field of the Invention

The present invention generally relates to a system for starting an aircraft turbine, and more particularly to a system for starting the turbine from a low voltage battery power supply.

DESCRIPTION OF THE PRIOR ART

U.S. Pat. No. 4,786,852, assigned to the same assignee as this invention, discloses an aircraft engine starting system in which a power generator coupled to the engine is driven as a motor during starting. This patent contemplates using an auxiliary power unit or the output of an already started turbine as the input to an inverter whose output drives the generator as a motor during starting. While generally satisfactory in its approach, this prior art system would not in many application be able to bring the turbine to a self sustaining speed if energized from a low voltage battery.

SUMMARY OF THE INVENTION

It is therefore an object of this invention to provide a system for controlling the input to the aircraft generator when driven as a motor in a starting operation so that the engine can be brought to a self sustaining operating speed using a low voltage battery. A part of this objective is to provide a system which does not add substantially to the cost or weight of the overall power generating system.

A specific object of the invention is to provide maximum power transfer from the battery to the generator during starting.

Briefly, this invention contemplates the provision of a system which is similar to the engine starting control system disclosed in a copending application, Ser. No. 07/448,669 filed Dec. 12, 1989, entitled Low Voltage Aircraft Engine Starting System and assigned to the same assignee as this application. That invention contemplates a low voltage source. In this invention, a low voltage battery is contemplated as the power source for energizing the aircraft generator to operate it as a motor during a starting operation. The battery is coupled to an input to an inverter whose a.c. output is controlled by a pulse width modulator. By controlling the switching points of the output, the generator is so energized that it operates as a brushless d.c. motor. As described more fully in the pending application, which is incorporated herein by reference, as the generator speed increases, its back emf increases, requiring an increasing voltage to maintain acceleration. When the inverter output voltage reaches the limit for the available supply voltage, the field is weakened and the commutation angle increased in order to continue to accelerate the turbine up to its operating speed. However, there is a limit to the extent to which the commutation angle can be increased and that limit would be exceeded before the engine is up to speed when attempting to start the engine from a low voltage power supply, such as a 28 volt battery, for example. A tap is added to an autotransformer used to step down the generator output when it is supplying power to the aircraft systems. At a point where the available voltage to the generator is insufficient to further accelerate the turbine, even with field weakening and an increased commutation angle, the autotransformer is switched into the system to step up the output voltage from the inverter input to the generator. In accordance with the teachings of this invention, throughout the starting operation, the commutation angle is controlled so that current drain on battery is such that the battery terminal voltage at one half its no load terminal voltage, thus providing maximum power transfer from the battery.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENT OF THE INVENTION

Figure 1:
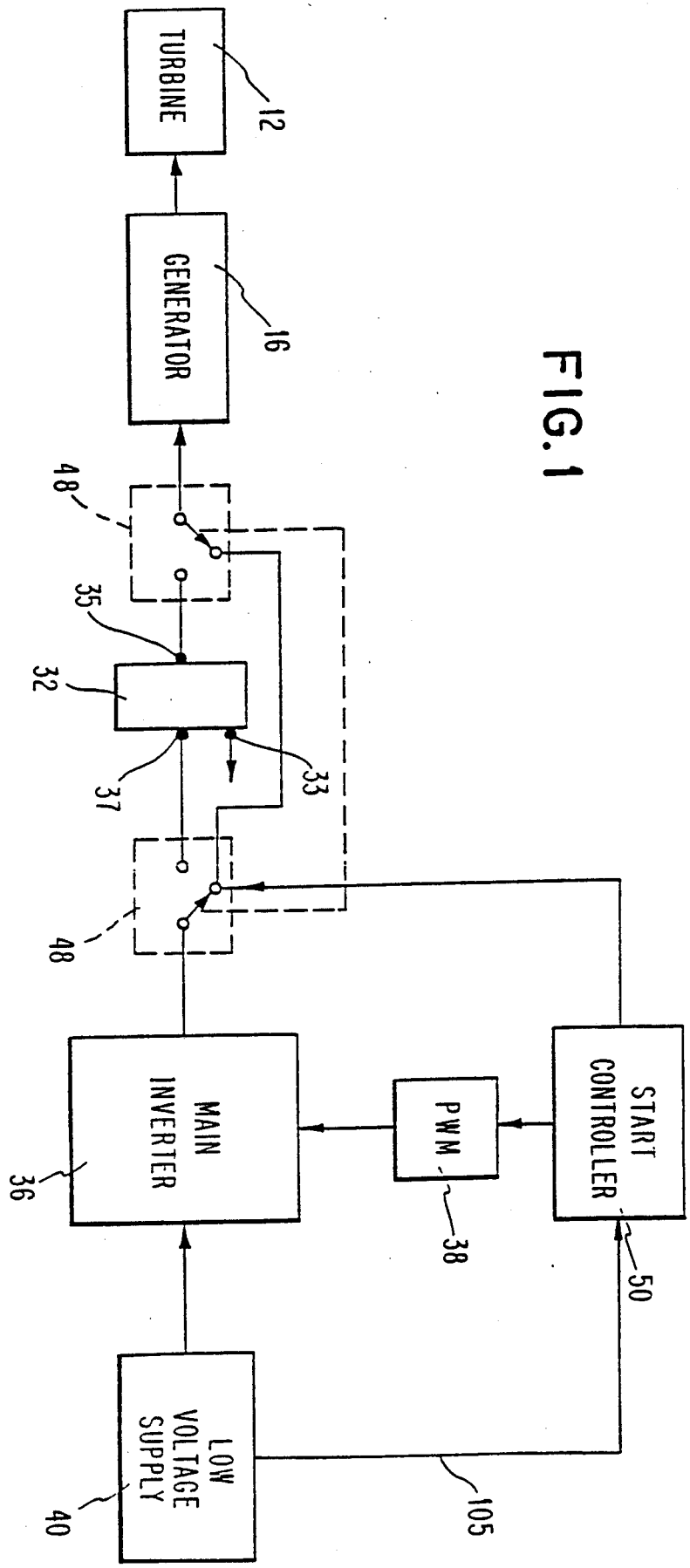
FIG. 1 is a simplified block diagram of an aircraft starting system in accordance with the teachings of this invention.
Figure 2:
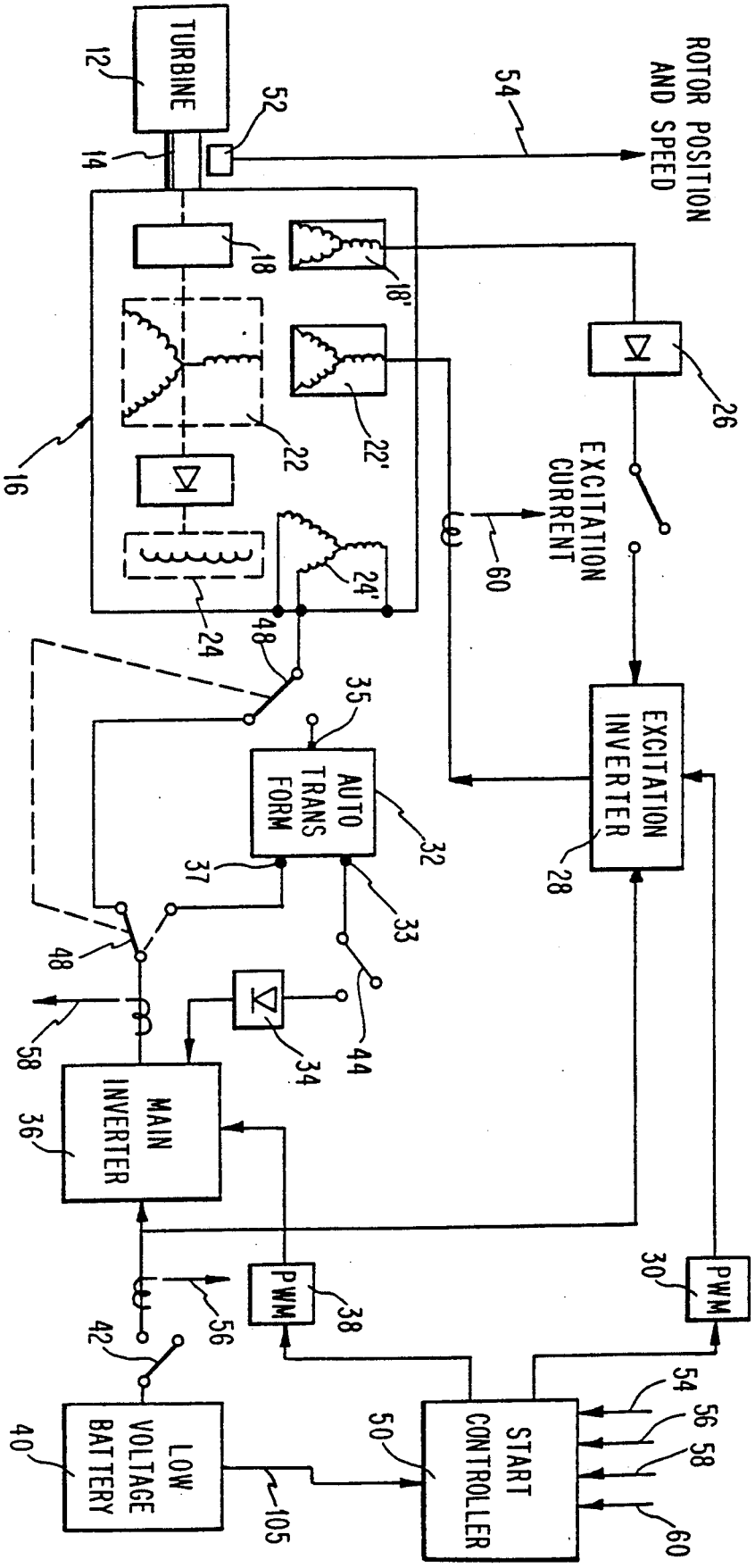
FIG. 2 is a more complete block diagram of a the aircraft start system shown in FIG. 1.

Referring now to the drawings, in which the same reference numeral indicates the same element in the various figures, and in particular FIGS. 1 and 2, FIG. 1 shows a typical aircraft turbine 12 which may be a main or auxiliary power unit. The turbine 12 is coupled by a shaft 14 to a generator 16 which serves to provide power for the aircraft during normal operation via a variable speed constant frequency inverter control system. As shown in FIG. 2, the generator 16 comprises a permanent magnet generator (permanent magnet rotor 18 and three phase stator 18') an exciter field generator (three phase rotor 22 and a.c. stator 22') and main power generator (d.c. rotor 24 and three phase stator 24'). The rotor of each generator is coupled to the shaft 14. As the generator 16 operates as a d.c. motor during starting it will be referred to herein as generator-motor 16, where in context such a designation is appropriate.

As is conventional in aircraft generator systems using a variable speed, constant frequency inverter control, the permanent magnet generator stator 18' is coupled via a rectifier 26 as an input to an inverter 28 whose output waveform is controlled by a pulse width modulator 30. The output of inverter 28 is coupled to the stator 22' of the exciter generator whose rotor 22 is coupled to the field winding 24 of the power generator. When operating as a generator to supply power for the aircraft, the stator 24' is coupled via a step down autotransformer 32 and a rectifier 34 to the input of an inverter 36 whose output is controlled by a pulse width modulator 38. It will be appreciated that the components and the system thus far described are the components and system used for generating power for an aircraft in a typical variable speed, constant frequency inverter system. These same components are used to start the engine from a low voltage battery power supply 40 in accordance with the teachings of this invention. The autotransformer 32 has a normal operating mode input tap 35 that in the starting mode is an output tap and a normal operating mode output tap 33. In generator operation to supply power, the autotransformer steps down the voltage of the generator. For starting, a third tap 37 (i.e., starting mode input tap) is added to the autotransformer to step up the voltage coupled from the inverter 36 to main stator winding 24' at a point in the starting operation when the output voltage of the inverter 36 reaches a limit of the available power supply voltage and further speed increases are not possible or are inefficient by weakening the field and increasing the commutation angle. At this point switch 48 couples the output of invertor 36 to starting mode input tap 37 to step up the voltage input to stator winding 24. With an increased voltage input available, the input voltage to the generator-motor is again increased as rotor speed increases until a self sustaining speed of the turbine is achieved or the limit of the available supply is reached. The switching point for the autotransformer can be established by the phase angle advance command, which controls the phase angle. The switching point can also be established as a predetermined turbine speed or a predetermined minimum acceleration of the turbine.

In starting, a switch 42 couples the low voltage battery supply 40 to the input of the inverter 36. A switch 44 disconnects the normal operating mode output tap 33 of autotransformer 32 from the input to the inverter 36 and a switch 48 connects the output of inverter 36 initially directly to the stator 24' of the main power generator. The pulse width modulator 38 in combination with a start controller 50 control the output of the inverter 36.

Switch 42 also couples the low voltage supply 40 to the input of the excitation inverter 28 whose output is controlled by the pulse width modulator 30 and the start controller 50.

In the starting operation, the inputs to the main generator-motor windings are switched so as to operate the generator as a brushless d.c. motor. A rotor position sensor 52, such as a resolver, has an output on line 54 which is coupled to the start controller 50 an provides input from which rotor speed and phase angle can be derived. Suitable current sensors 56, 58, and 60 sense respectively the supply current from low voltage source 40, the input current to the stator 24' and the input current to the excitation stator winding 22'.

Figure 3:
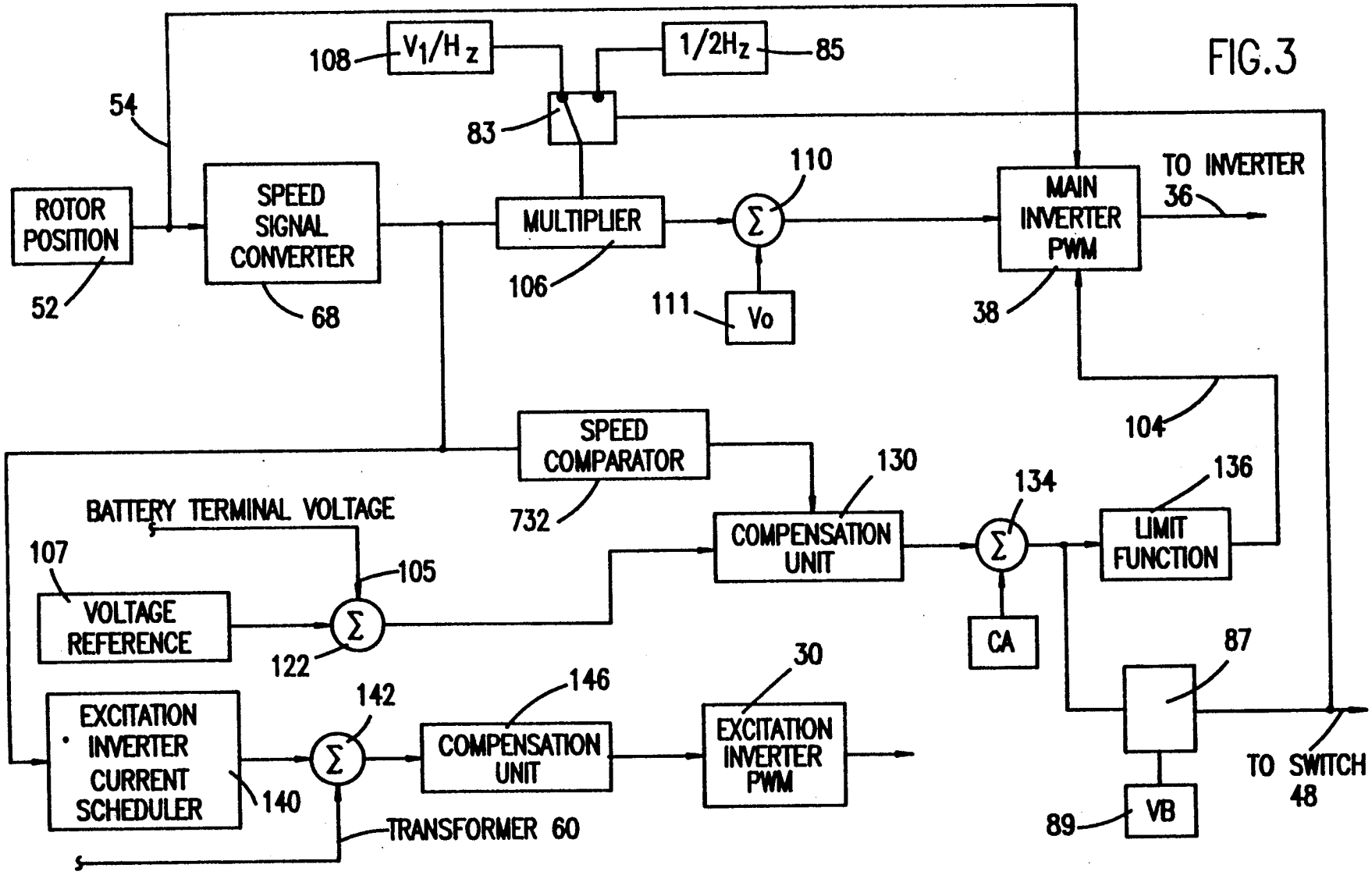
FIG. 3 is a block diagram of one embodiment of a control system for use in controlling the input to the generator in accordance with the teachings of this invention.

Referring now to FIG. 3 in addition to FIGS. 1 and 2, as mentioned above, the output of the main inverter pulse width modulator 38 controls the output of the inverter 36 to the end that the inverter output drives the main generator-motor of the turbine as a brushless d.c. motor during starting. The duty cycle of the modulator 38 output is varied in accordance with inputs indicative of speed and phase angle.

The magnitude of the output voltage of the inverter 36 is a function of the duty cycle of the pulse width modulator 38 and this duty cycle is increased as the engine speed increases. To this end, a convertor 68 converts the output of rotor position sensor 52 to a signal proportional to rotor speed. A multiplier 106 multiplies the speed signal initially with a reference 108 which establishes the slope of the voltage input curve as a function of rotor speed. The output of multiplier 106 is coupled to the input of the modulator 38 via a summing circuit junction 110 which adds a "boost" voltage based on reference 111 to offset the IR drop of the generator at low speed.

The fundamental frequency of the pulse width modulator 38 and hence the fundamental frequency of the inverter 36 is controlled so that it is proportional to the rotor speed. The output of the rotor position sensor 52 is coupled to the pulse width modulator 38 to synchronize the output phase with the rotor position.

The commutation angle is controlled in order to establish and maintain a current drain on battery 40 during starting such that the terminal voltage is approximately equal to one half the battery terminal voltage at no load. A commutation angle input signal on line 104 to modulator 38 establishes the phase difference between the rotor position and the inverter output. The commutation angle input signal on line 104 is developed by comparing the battery terminal voltage on line 105 to a reference 107 equal to one half the battery terminal voltage at no load. The value of reference 107 may based on an assumed nominal value, as the battery source no-load terminal voltage will be known in many applications. It may also be established by actual measurement of the no load voltage prior to the start operation. As will be appreciated by those skilled in the art, by controlling the current drain during starting to maintain the potential across the battery terminals at one half its no load potential, maximum power will be delivered from the battery source 40. A summing junction 122 develops an error signal which is the difference between battery terminal voltage and the reference. The difference output of junction 122 is coupled to the input of the modulator 38 via a compensation unit 130, a summing junction 134, and a limit function 136. The compensation unit 130 provides stability in controlling input current by using proportional and integral control algorithms for speeds above a preselected minimum operating speed. The compensation unit receives an enable command from a speed comparator 132 which compares the engine speed with a value that indicates a minimum speed, below which closed loop control is not used. The output of the compensation unit 130 establishes the commutation angle. A reference CA is summed with the output of the compensation unit and establishes a minimum commutation angle for speeds below the minimum speed in which closed loop control is not used. At speeds above the minimum, the commutation angle is a function of output of the compensation unit and the reference CA. A limit function 136 prevents the commutation angle from exceeding a predetermined minimum angle, irrespective of the input from summing junction 134.

The field current in rotor winding 24 is controlled via an input to the exciter pulse width modulator 30 which controls the duty cycle of the modulator output. An excitation inverter current scheduler 140 stores a table of desired excitation current vs engine speed. The output of the current scheduler is compared with the output of current transformer 60 at junction 142 and the difference signal is coupled to excitation pulse width modulator 30 via a compensation unit 146 which contains a proportional integral algorithm.

Figure 4:
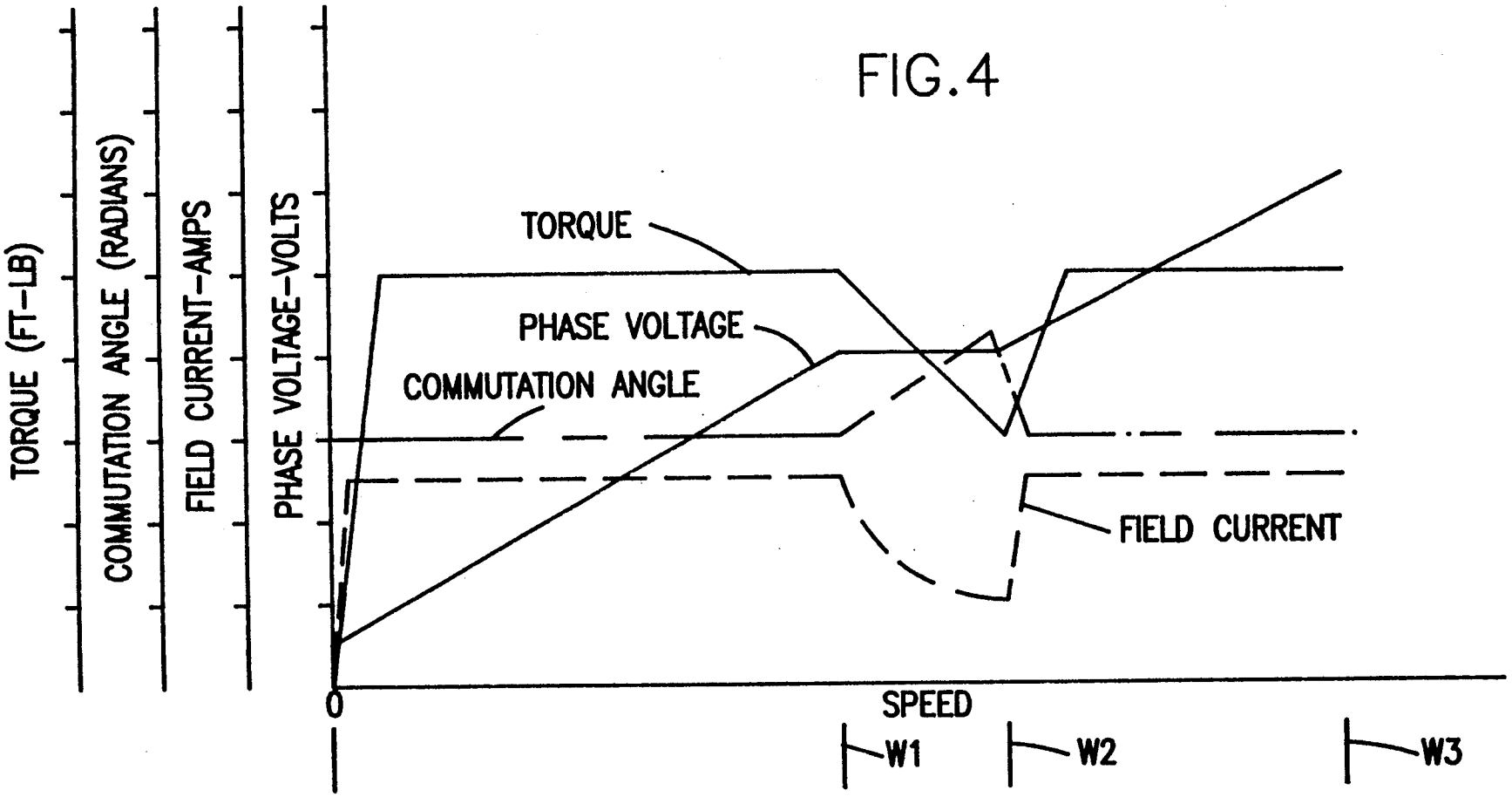
FIG. 4 is a set of curves illustrating various generator parameters as a function of speed for the embodiment of the invention described in connection with FIGS. 1, 2, and 3.

Referring now to FIG. 4 in addition to the previous FIGS., at the beginning of the start mode of operation the speed is zero and the commutation angle is established by the constant CA, since the compensation unit 130 is disabled. The applied voltage to the rotor winding 24' is established by the boost voltage Vo. The field current in rotor winding 24 is established and held a predetermined value by controlling the exciter stator current via the excitation current generator scheduler 140 and pulse width modulator 28. As the speed increases the applied voltage to the stator 24' increases and the stator current and commutation angle are held essentially constant by reference 107 at a level whereby the IR drop through the battery and the power leads from the battery equals one half the battery no load voltage. As the speed increases, the back emf of the generator-motor increases. At a speed W1, the inverter 36 applies the maximum available voltage of source 40. To obtain a continued increase in engine speed, the field current is decreased and the commutation angle increased. At a speed W2, the commutation angle is at an angle where any further increase would result in unstable operation. At this point, in order to continue to increase engine speed, switch 48 couples the output of the inverter to autotransformer tap 37 operating in the starting mode as an input tap and couples tap 35 operating in the starting mode as an output tap to generator-motor 16. A switch 83 couples a volts per hertz reference 85 to the input of multiplier 106. The output of a comparator 87, which compares the phase angle advance command output of junction 134 to a reference 89, operates the switches 83 and 48. The output voltage of inverter 36 again increases with speed along a slope determined by reference 85 until the turbine accelerates to its self sustaining operating speed W3. Throughout the starting operation, the battery terminal voltage is maintained at one half its no load voltage.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A system for starting an aircraft turbine from a low voltage power supply by energizing a generator coupled to said turbine to operate as a motor during starting, comprising in combination:

an inverter having a direct current input coupled to said low voltage battery and an alternating current output;

an autotransformer having a starting mode input tap and a starting mode output tap, said autotransformer coupling a stepped up voltage between said input tap and output tap;

means for coupling said output tap to said generator;

control means for coupling said inverter output to said generator initially during starting and thereafter coupling said inverter output to said transformer input tap; and means for controlling the input current to said generator to maintain the battery terminal voltage during starting at a predetermined level.

2. A system for starting an aircraft turbine as in claim 1, wherein said predetermined level is approximately equal to one half the no load battery terminal voltage.

3. A system for starting an aircraft turbine by energizing a generator coupled to said turbine from a low voltage battery power supply to cause said generator to operate as a motor, comprising in combination:

an inverter having a direct current input coupled to said low voltage battery and an alternating current output;

control means for coupling said inverter output to said generator during starting; and means for controlling the input current to said generator during starting to maintain the battery terminal voltage at a level approximately equal to one half the no load battery terminal voltage.

4. A system for starting an aircraft turbine as in claim 3 wherein said means for controlling input current includes means for controlling the commutation angle of said generator.

5. A system for starting an aircraft turbine as in claim 3 wherein said coupling means includes an autotransformer.

6. A system for starting an aircraft turbine as in claim 4 wherein said coupling means includes an autotransformer.

7. A system for starting an aircraft turbine as in claim 1 wherein said generator operates as a brushless d.c. motor.

* * * * *